United States Patent [19]

Robison

[11] 3,942,717

[45] Mar. 9, 1976

[54] SPECIMEN CONTAINER

[76] Inventor: William O. Robison, 524 Raymond, Santa Monica, Calif. 90405

[22] Filed: Mar. 10, 1975

[21] Appl. No.: 556,551

Related U.S. Application Data

[63] Continuation of Ser. No. 331,330, Feb. 9, 1973, abandoned.

[52] U.S. Cl. ..... 233/26; 23/292; 210/DIG. 24

[51] Int. Cl.[2] ..... B04B 9/12

[58] Field of Search ..... 233/26, 1 R, 27; 210/83, 210/513, DIG. 24, 361; 23/292, 259, 253 R

[56] References Cited

UNITED STATES PATENTS

| | | | |
|---|---|---|---|
| 3,478,889 | 11/1969 | Fessler | 210/361 X |
| 3,481,712 | 12/1969 | Bernstein et al. | 23/292 |
| 3,684,455 | 8/1972 | Vacirca et al. | 23/253 R |
| 3,720,502 | 3/1973 | Gropper et al. | 210/DIG. 24 |
| 3,779,383 | 12/1973 | Ayres | 210/DIG. 24 |

*Primary Examiner*—George H. Krizmanich
*Attorney, Agent, or Firm*—Fulwider, Patton, Rieber, Lee & Utecht

[57] ABSTRACT

A specimen container of generally tubular construction and formed with a base tube defining a specimen-receiving chamber for receipt of a fecal specimen or the like and which is flared outwardly at its upper extremity for receipt of the open lower end of a tubular top member formed in its lower extremity with inwardly flared walls for frictionally engaging the outward flare of the base tube. The top member is formed interiorally with a conical wall which is open in its upper extremity to define an access orifice for analysis of a specimen contained therein. A cap is provided for covering the top member whereby a specimen may be placed in the base tube and the top member mounted on such base with the cap in position overlying the access orifice. The container may then have a fluid added thereto and the entire container then spun in a centrifuge with the base disposed radially outwardly in such centrifuge to cause the high density material in such specimen to seek the bottom of such base and the low density material, such as parasite eggs, to be forced upwardly in the container to be disposed in such orifice for easy access thereto when the cap is removed.

3 Claims, 4 Drawing Figures

SPECIMEN CONTAINER

This application is a continuation of application Ser. No. 331,330, filed Feb. 9, 1973, now abandoned.

BACKGROUND OF THE INVENTION

1. Field of the Invention

The specimen container of present invention relates generally to an analyzing container and more particularly to a container which may be utilized to analyze a fecal specimen.

2. Description of the Prior Art

Various proposals have been made for the construction of analyzing containers which may be utilized to analyze fecal specimens. However, all prior art fecal specimen containers known to applicant are relatively inconvenient to use and/or relatively complicated in construction thus being rather expensive to manufacture.

SUMMARY OF THE INVENTION

The fecal specimen container of the present invention is characterized by a tubular base portion formed with a specimen-receiving chamber and terminating in its upper extremity in an upwardly opening coupling flare. A top member is formed with a downwardly opening inwardly tapered flare which is received frictionally in the upwardly opening flare and includes an interior conically shaped wall which tapers upwardly and inwardly to terminate in an upwardly opening access orifice. A cap is provided for covering the top end of such top member. Thus, a fecal specimen may conveniently be disposed in the base member, the top member coupled to such base member to form a liquid tight seal and the container filled to the level of such orifice with a high density saline solution and the cap placed in position. The entire container may then be spun in a centrifuge and any parasitic eggs in the fecal specimen which are more bouyant than the saline solution will be buoyed upwardly in the saline solution to float within the orifice for convenient access thereto for medical analysis.

The objects and the advantages of the present invention will become apparent from a consideration of the following detailed description when taken in conjunction with the accompanying drawing.

DESCRIPTION OF THE PREFERRED EMBODIMENT

Figure 1:
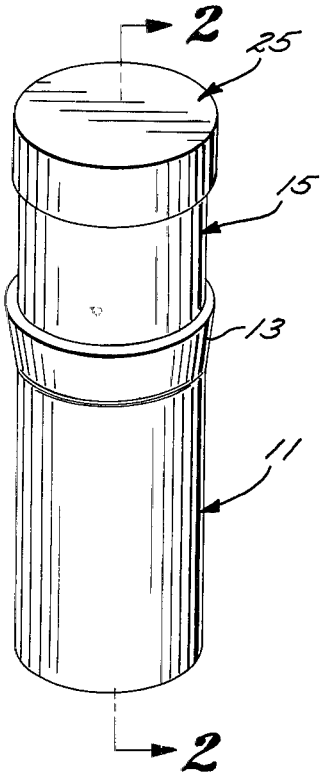
FIG. 1 is a perspective view of a specimen container embodying the present invention.
Figure 2:
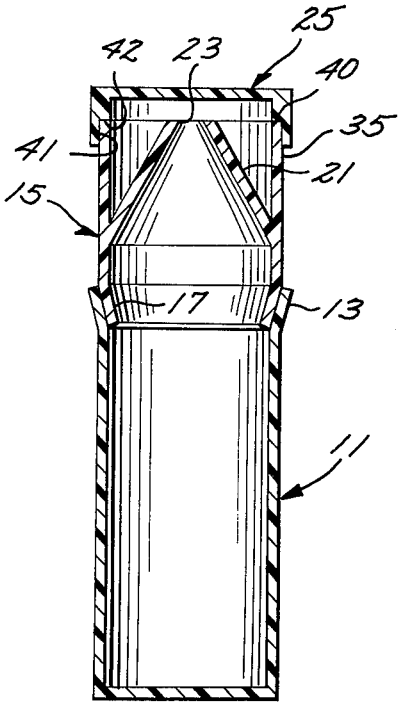
FIG. 2 is a vertical sectional view taken along the line 2—2 of FIG. 1.
Figure 3:
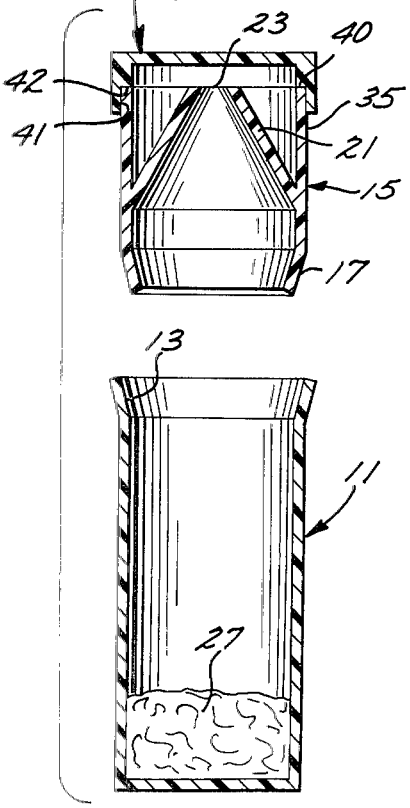
FIG. 3 is a longitudinal sectional view similar to FIG. 2 but showing the base and top member separated.
Figure 4:
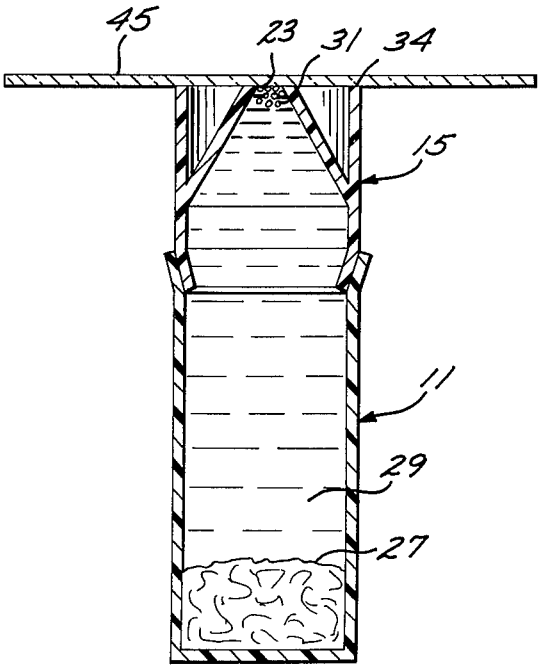
FIG. 4 is a longitudinal sectional view similar to FIG. 2 and showing a slide positioned over the access orifice shown in the container in FIG. 1.

Referring to FIGS. 2 and 3, the specimen container of the present invention includes, generally, a base tube 11 formed with an upwardly opening outwardly tapered female coupling flare 13 and a tubular top member 15 formed with a downwardly and inwardly tapered male coupling flare 17 for receipt in such coupling flare 13. The top member 15 is formed interiorally with a conical wall 21 which tapers inwardly and upwardly and terminates in its upper end at an access orifice 23. A removable cap 25 is provided for covering the upper end of such member 15. Thus, the base tube 11 and top member 15 may be separated and a fecal specimen 27 placed in the base member 11 and the top member 15 then joined therewith. The container may then be filled with a high density saline solution 29 and rotated at a high rate of speed in a centrifuge to cause any low density parasitic eggs or the like to be buoyed upwardly in the relatively dense saline solution to collect at the orifice 23 for convenient access thereto for analysis.

The container of the present invention is preferably constructed of a transparent plastic and the base 11 may be in the form of a thin walled tube which is flared outwardly at its upper extremity to form a standard female taper 13.

The top member 15 may also be tubular shaped and is formed with a cylindrical peripheral wall 35 which extends downwardly and tapers inwardly to form a standard male taper 17 for frictional receipt and retention within the female taper 13.

The top member 15 is formed interiorally with the intermediate wall 21 which is shaped in the form of an inverted cone and terminates in its upper extremity in the access orifice 23. Such access orifice 23 is disposed in the same plane as the top edge 40 of the peripheral wall 35 and is sufficiently small to adequately converge the parasitic eggs contained in a normal stool specimen for convenient collection and analysis.

A snap cap 25 is provided for overfitting the peripheral wall 35 and is in the form of a downwardly opening cup forming a circular flange 41 which is formed in its lower portion with a cut back portion 42 which telescopes over the upper extremity of the peripheral wall 35 and cooperates with such wall to hold the cap 25 frictionally in place. The cut back portion 42 forms a downwardly facing annular shoulder 44 which abuts the top edge 40 of the peripheral wall 35 to limit downward telescoping of such cap 25 on the wall 35 to maintain the top wall of such cap spaced from the orifice 23.

In operation, the specimen container of the present invention is normally provided in a sterile condition and the top member 15 may be separated from the base tube 11 by merely pulling such top member and base tube apart at the interfitting male and female tapers 17 and 13. With the relatively large opening formed by the female flare 13, the stool specimen 27 may conveniently be placed within the base 11 and the top member 15 again coupled to such base member by fitting the flare 17 within the flare 13.

The snap cap 25 may then be removed from the top member 15 and a small diameter tube utilized to introduce a saturated saline solution into the orifice 23 to fill the entire chamber formed by the joined base 11 and top member 15 thus providing fluid to the level of the access orifice 23. The snap cap 25 may then be snapped into position as shown in FIG. 3 to prevent spillage while leaving the orifice 23 free for unobstructed collection of eggs 31. The entire container may then be mounted in a standard centrifuge and the centrifuge actuated to spin the container in a circular path at a high rate of speed and in an orientation with the top thereof disposed radially inwardly with respect to the bottom thereof to thus cause the saline solution to be forced to the bottom of the container while the comparatively buoyant parasitic eggs 31 are forced radially inward with respect to the path followed in such centrifuge to be converged in the orifice 23. In this respect, it will be appreciated that while it is desirable to have a relatively wide opening to the base 11 for convenient receipt of the stool specimen 27, it is also desirable to have a relatively small access orifice 23 for convergence of the parasitic eggs 31 in a relatively small collection area for collection thereof through such access orifice. In the preferred embodiment the opening defined by the flare is 1.2 inches in diameter while the orifice 23 is 0.15 inches in diameter thus creating a ratio of 1 to 8. In practice the ratio should not fall below 5 to 1.

The container may then be removed from the centrifuge and the cap 25 snapped off the top member 15, it being realized that the top wall thereof has been maintained spaced from the orifice 23 thus permitting collection of the eggs 31 without adherence thereof to such cap. A microscope slide 45 may then be placed over the top end of the top member 15 and the eggs 31 disposed within the orifice 23 will adhere thereto so such slide may subsequently be removed and placed under a microscope or otherwise used in the analysis of the parasitic eggs 31.

The container may then subsequently be disassembled and the saline and specimen mixture dumped therefrom and the entire container washed and sterilized for subsequent use in analyzing other specimens.

From the foregoing it will be apparent that the specimen container of the present invention provides a convenient and economical means for collecting and centrifuging fecal specimens to converge eggs included therein at an orifice for convenient collection on a slide for subsequent analysis.

Various modifications and changes may be made with respect to the foregoing detailed description without departing from the spirit of the present invention.

I claim:

1. A specimen container for a centrifuge comprising:

a tubular base formed with a specimen-receiving chamber having a closed end and terminating at its opposite extremity with an outwardly flared skirt forming a relatively large specimen-receiving opening;

a tubular top member formed at its lower extremity with an inwardly tapered section received in said skirt, said top member being further formed with an upwardly tapered, inwardly converging top wall terminating at the end of its taper in a relatively small orifice and a peripheral wall projecting upwardly therearound; and a cap fitted telescopically over the top end of said peripheral wall and including a top wall spaced from said orifice whereby said base and top may be separated, a specimen adapted to be analyzed insertable through said specimen-receiving opening into said chamber, and said container adapted to be centrifuged to cause buoyant particles in said specimen to float to the top thereof for disposition in said orifice for subsequent collection.

2. A specimen container as set forth in claim 1 wherein:

said peripheral wall projects coaxially about said top wall and terminates in the plane of said orifice.

3. A specimen container as set forth in claim 1 wherein:

said cap includes an annular wall telescoping over said peripheral wall and formed with shoulder means engagable with the end of said peripheral wall to limit fitting together of said cap and top member to maintain said top wall spaced from said orifice.

* * * * *